US006003368A

United States Patent [19]

Naruo et al.

[11] Patent Number: 6,003,368

[45] Date of Patent: Dec. 21, 1999

[54] SHAFT SELECTION AIDING APPARATUS FOR SELECTING OPTIMUM SHAFT FOR A GOLFER

[75] Inventors: Takeshi Naruo; Takeshi Saito; Shuichi Noguchi, all of Osaka, Japan

[73] Assignee: Mizuno Corporation, Osaka, Japan

[21] Appl. No.: 08/967,824

[22] Filed: Nov. 12, 1997

Related U.S. Application Data

[62] Division of application No. 08/656,336, filed as application No. PCT/JP95/02086, Oct. 12, 1985, Pat. No. 5,821,417.

[30] Foreign Application Priority Data

Oct. 17, 1994 [JP] Japan ..... 6-250474
Jan. 27, 1995 [JP] Japan ..... 7-11513

[51] Int. Cl.[6] ..... G01P 15/00

[52] U.S. Cl. ..... 73/489; 473/233; 473/289

[58] Field of Search ..... 73/65.03, 493, 73/12.01, 649, 379.01, 491, 492, 488, 489; 473/233, 223, 289, 287

[56] References Cited

U.S. PATENT DOCUMENTS 3,945,646 3/1976 Hammond ..... 73/493
4,138,118 2/1979 Budney ..... 273/183 D
4,261,566 4/1981 MacDougall ..... 273/77 A
4,375,887 3/1983 Lynch et al. ..... 273/32 H
5,351,952 10/1994 Hackman ..... 273/77 A
5,441,256 8/1995 Hackman ..... 273/77 A
5,478,073 12/1995 Hackman ..... 273/77 A
5,511,789 4/1996 Nakamura ..... 473/202
5,527,036 6/1996 Hutchings ..... 473/220

FOREIGN PATENT DOCUMENTS 63-257583 10/1988 Japan .
1-258276 11/1989 Japan .

*Primary Examiner*—Christine K. Oda
*Attorney, Agent, or Firm*—McDermott, Will & Emery

[57] ABSTRACT

A high speed camera takes an image in the vicinity of a ball 3 and a club head 12, while a high speed camera 5 takes an image in the vicinity of the top of the swing of a golfer 1, and the images are recorded in a high speed video tape recorder 6. The recorded images are reproduced, swing time, a swing speed and a head speed are detected using a personal computer 15, and a shaft with an optimum flex for the golfer is selected based on the swing time, the swing speed, the swing time and the head speed, or the swing speed and the head speed.

5 Claims, 13 Drawing Sheets

SHAFT SELECTION AIDING APPARATUS FOR SELECTING OPTIMUM SHAFT FOR A GOLFER

This application is a division of application Ser. No. 08/656,336 filed Jun. 14, 1996, allowed Oct. 9, 1997 filed as PCT/JP95/02086 on Oct. 12, 1995.

FIELD OF THE INVENTION

The present invention relates generally to an apparatus for selecting a shaft with an optimum flex for a golfer, and more particularly, to an apparatus for selecting an optimum flex for a golfer by which the golfer can select a shaft with a flex the most suitable for him/her.

DESCRIPTION OF THE BACKGROUND ART

Golf clubs having a variety of shaft flexes are available, and a golfer must select a golf club with a flex the most suitable for him/her. Conventionally, an optimum flex for a golfer used to be determined based only on a head speed produced from time required for a club head to move over a fixed distance till impact.

In recent years, as more people enjoy playing golf, some people complain about their shafts being too stiff or being too flexible. Such complaints do not agree with the head speed standards. Manufacturers have changed their standards into a variety of forms from time to time accordingly, but all such new standards are still based on head speed standards, and other measures have not been taken.

The flex standards described herein are based on frequency values, and standards based on values representing the tip deflection of a shaft plumped horizontally at the butt end by hanging established weight on the tip are also encountered with the same problem. The following Table 1 sets forth the relation between basic flexes and their frequencies.

TABLE 1

| Flex | Frequency (cpm) |
|---|---|
| L | 235 ± 10 |
| A | 245 ± 10 |
| R | 260 ± 10 |
| S | 275 ± 10 |
| X | 290 ± 10 |
| XX | 300 ± 10 |

The inventors et al. conducted sensory evaluation in which a number of amateur golfers appreciated items such as "carry distance", "directional controllability", and "readiness of timing" about golf clubs (drivers) with different flexes. As a result, no significant difference was found about the two items "carry distance" and "directional controllability", while people supposed to use flexes about in the range from 270 to 280 cpm (cycle per minute) with head speeds in the range from 42 to 45 m/sec according to a conventional selecting method selected shafts whose flexes vary from 249 to 288 cpm. The inventors et al. therefore came to believe that an optimum flex for a golfer cannot be determined based only on a head speed.

Note that the swing speeds were also measured at 0.01-second intervals from 0.1 second before till the top of the swing, errors of swing speeds by a number of golfers were smallest at 0.08 second before the top of the swing, and therefore swing speeds were limited to those at 0.08 second before.

As a result of a study for providing golfers with shafts with optimum flexes, the inventors et al. came to a conclusion that the speed of a club head at 0.08 second before the top (hereinafter referred to as swing speed) rather than the speed at the top of the swing, i.e., the state in which the head completely stays still, the amount of strain of the shaft at impact, swing time, and acceleration are the most critical factors for determining optimum shaft flexes for individual golfers.

It is therefore an essential object of the present invention to provide an apparatus for selecting a shaft with an optimum flex for a golfer which makes it possible for the golfer to find a point the most suitable for timing or a flex the most comfortable to hit by measuring one of swing time, swing speed, acceleration and the amount of deflection of a shaft.

DISCLOSURE OF INVENTION

An apparatus for selecting a shaft with an optimum flex for a golfer according to the present invention detects swing time from the start of swing till impact, and selects a shaft with an optimum flex for the golfer based on the detected swing time.

According to another aspect of the invention, the speed of a club head in the vicinity of the top of the swing of the club is detected, and a shaft with an optimum flex for a golfer is selected based on the detected speed.

According to a further aspect of the invention, the acceleration of a club head in the vicinity of the top of the swing is detected, and a shaft with an optimum flex for a golfer is selected based on the detected acceleration of the club head.

According to an additional aspect of the present invention, the movement of a club head in the vicinity of a ball as well as in the vicinity of the top of the swing when a golfer swings and hits the ball is video-taped, swing time from the start of the swing till impact is detected based on the video-taped image, the amount of deflection or the amount of strain of the shaft when the golfer swings the golf club and the hits the ball is measured, the amount of deflection or the amount of strain of the shaft at the top of the swing is detected based on the detected swing time in response to the measurement of deflection amount or strain amount of the shaft, and a shaft with an optimum flex for the golfer is selected based on the detected output.

According to another additional aspect of the invention, swing time from the start of swing till impact and the speed of the club head at impact are detected, and a shaft with an optimum flex for a golfer is selected based on the detected swing time and the speed of the club head at impact.

According to a further aspect of the invention, the speed of a club head in the vicinity of the top of the swing and the speed of the club head at impact are detected, and a shaft with an optimum flex for a golfer is selected based on the detected speed and the speed of the club head at impact.

According to a still further aspect of the invention, the acceleration of a club head in the vicinity of the top of the swing and the speed of the club head at impact are determined, and a shaft with an optimum flex for a golfer is selected based on the detected acceleration of the club head and the speed of the club head at impact.

According to a still further aspect of the invention, the movement of a club head in the vicinity of a ball when a golfer swings the club and hits the ball as well as in the vicinity of the top of the swing is video-taped, swing time from the start of swing till impact is detected based on the video-taped image, the deflection amount or strain amount of the shaft when the golfer swings the golf club and hits the ball is measured, the deflection amount of the strain amount of the shaft at the top of the swing is detected based on the detected swing time in response to the measurements of the deflection amount or strain amount of the shaft and a shaft with an optimum flex for the golfer is selected based on the detected output and the speed of the club head at impact.

According to a further additional aspect of the invention, a shaft with an optimum flex for a golfer is selected based on deflection or strain.

According to a further additional aspect of the invention, the amount of deflection or strain of the shaft when a golf ball is hit is detected using a strain gauge and thus detected deflection amount or strain amount is counted or expressed by values.

BEST MODE FOR PRACTICING THE INVENTION

Figure 1:
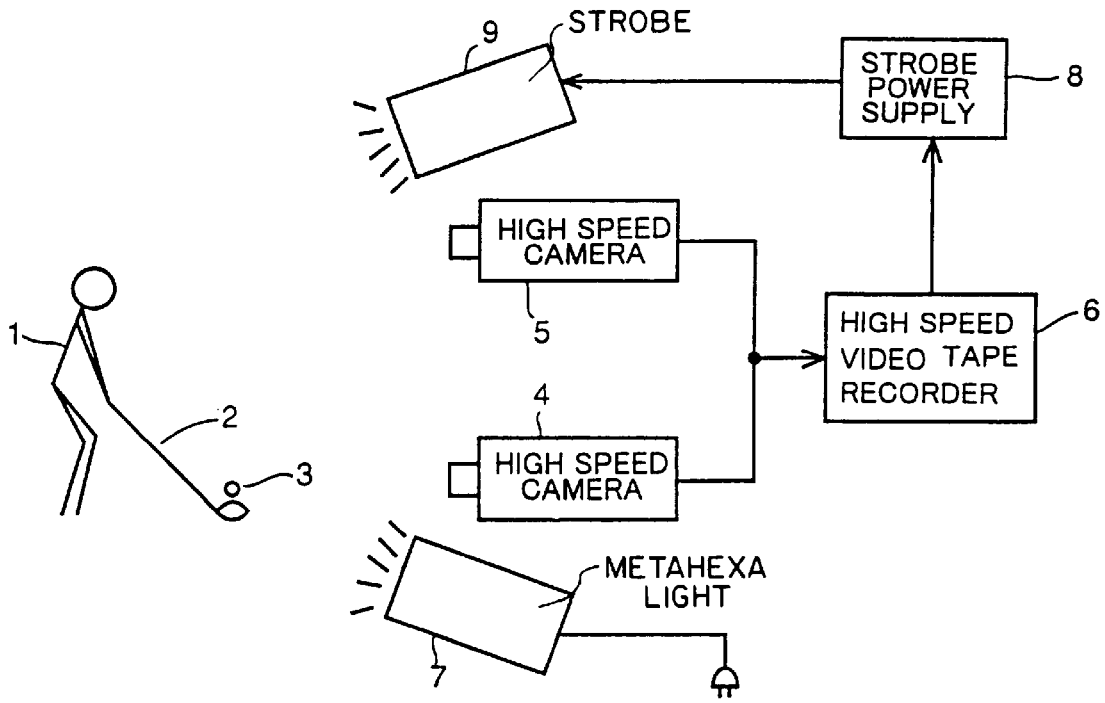
FIG. 1 is a block diagram schematically showing an image-taking/recording system for image-taking/recording the movement of a club head in a first embodiment of the invention.

FIG. 1 is a block diagram schematically showing an image-taking/recording system for image-taking/recording the movement of a club head in one embodiment of the invention. In FIG. 1, a high speed camera is placed in order to take the image of a part of a ball 3 from the front when a golfer 1 swings a club 2 and hits the ball. A high speed camera 5 is placed in order to take the image of the top of the head of golfer 1 from the front. These high speed cameras 4 and 5 whose number of frames is 1/200 sec take the images at a time. Video outputs from high speed cameras 4 and 5 are recorded by a high speed video tape recorder 6. A metahexa light 7 is provided to illuminate golfer 1 and ball 3. Further, in order to strobe-illuminate golfer 1 a strobe light 9 is provided, which is activated by a strobe power supply 8 and emits light in response to pressing of the recording button of high speed video tape recorder 6 before golf 1 starts swinging golf club 2.

Figure 2:
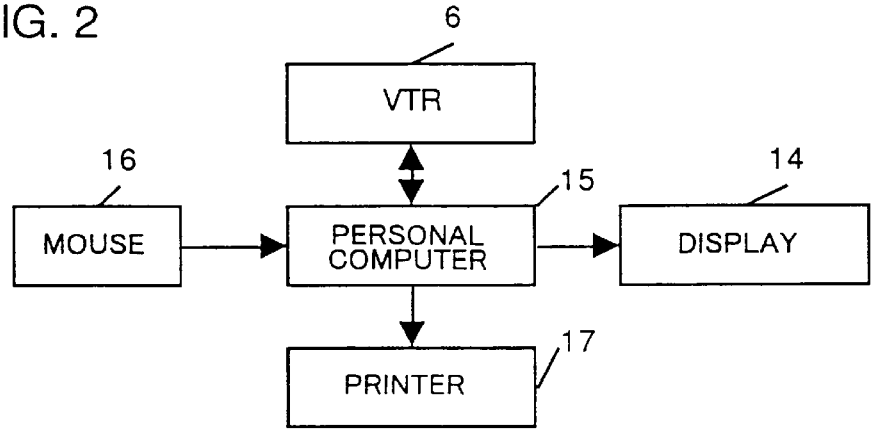
FIG. 2 is a block diagram schematically showing a detection device for detecting swing time and swing speeds.

FIG. 2 is a block diagram schematically showing the detection device for detecting swing time, swing speed and the speed of a club head at impact. As shown in FIG. 2, the detection device is formed by a connection of a personal computer 15, high speed video tape recorder 6 shown in FIG. 1, a display 14, a mouse 16, and a printer 17.

Figure 3:
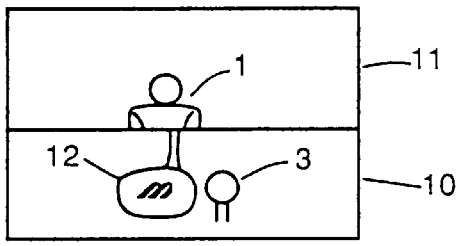
FIG. 3 is a diagram showing an example of an image displayed in the display shown in FIG. 2.

FIG. 3 is a diagram showing an image displayed in display 14 shown in FIG. 2. In display 14, the image of golfer 1 taken by high speed camera 5 is displayed as an upper half image 11, while the image of ball 3 and club head 12 taken by high speed camera 4 is displayed as a lower half image 10.

Figure 4:
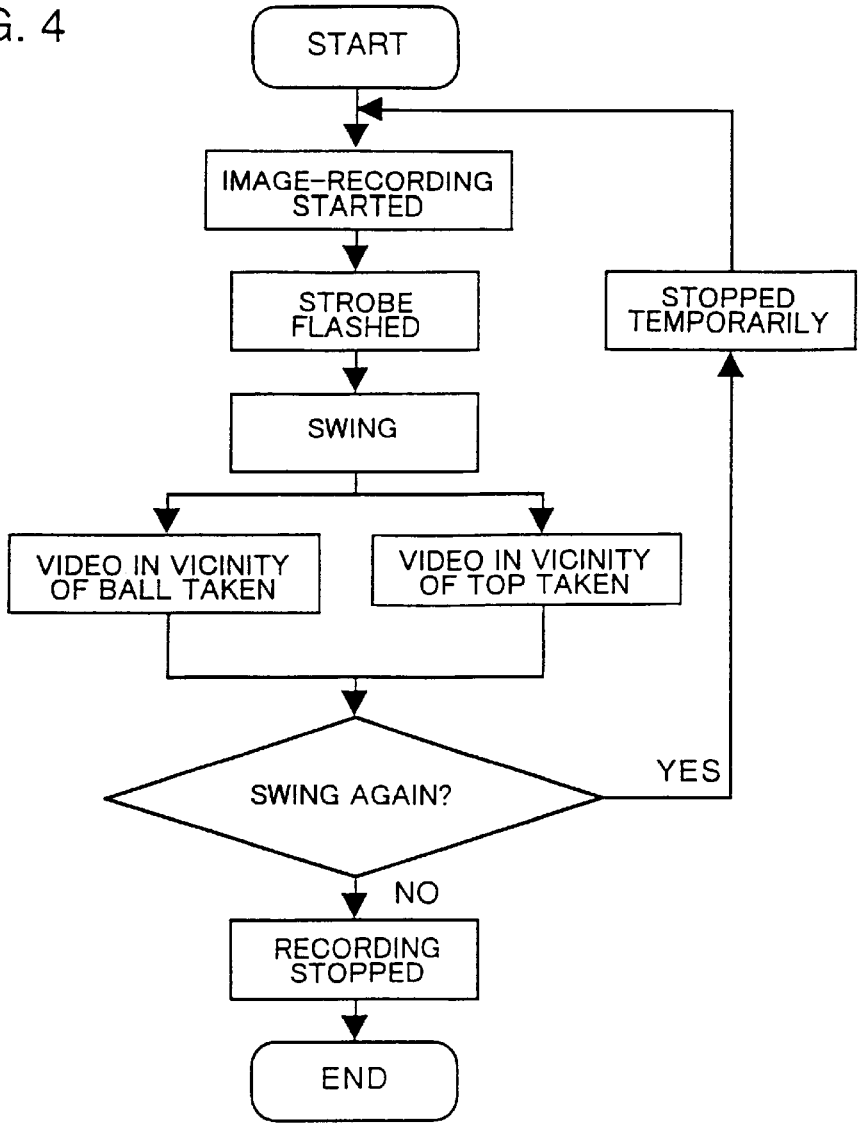
FIG. 4 is a flow chart for use in illustration of the procedure of image-taking/recording by the image-taking/recording system shown in FIG. 1.
Figure 5:
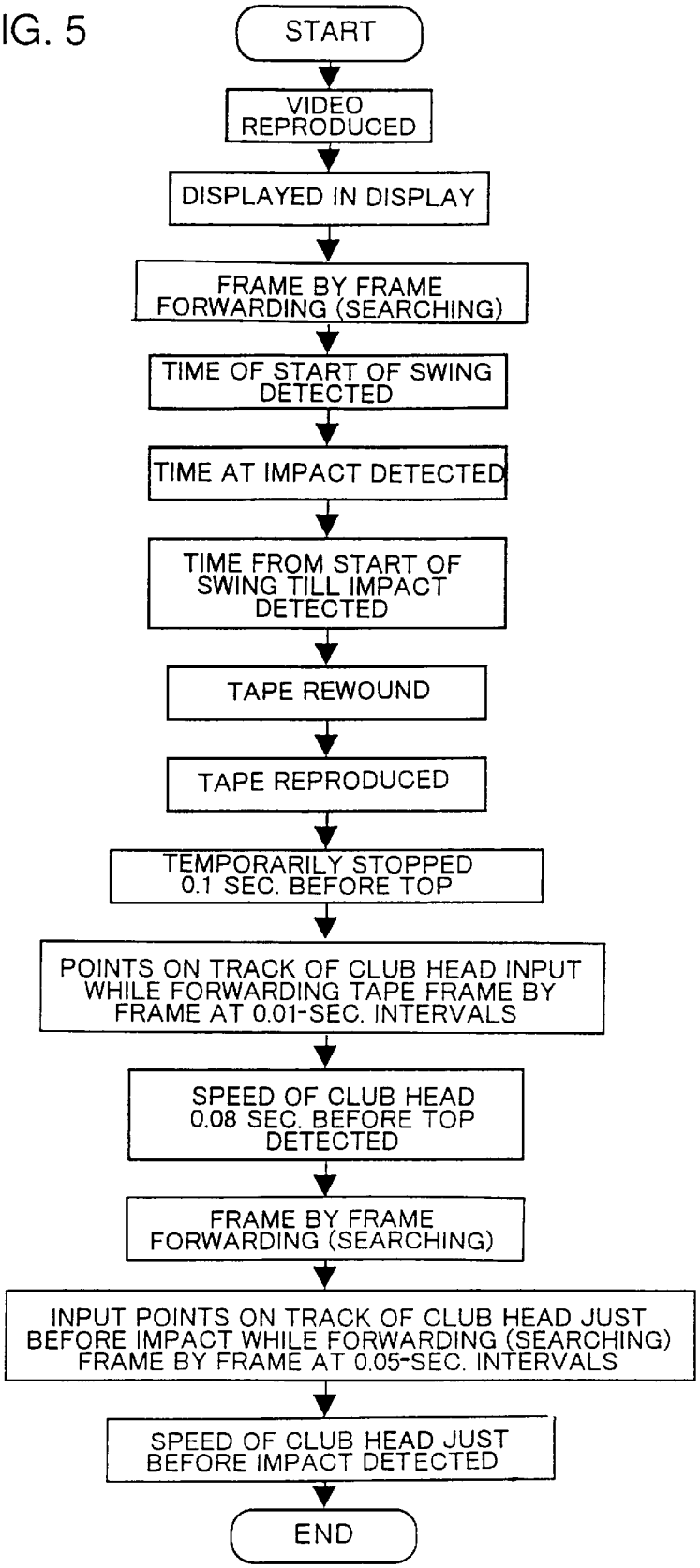
FIG. 5 is a flow chart for use in illustration of the procedure of detection by the detection device shown in FIG. 2.
Figure 6:
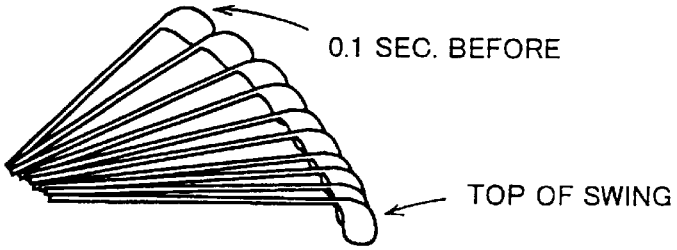
FIG. 6 is a view showing the movement of a club head from 0.1 second before the top of the swing till the top of the swing at 0.01-second intervals.

FIG. 4 is a flow chart showing the procedure of image-taking/recording by the image-taking/recording system shown in FIG. 1. FIG. 5 is a flow chart for use in illustration of the procedure of detection by the detection device shown in FIG. 2, and FIG. 6 is a view showing the movement of a club head 12 from 0.1 second before till the top of the swing.

Now, referring to FIGS. 1 to 6, operations in one embodiment of the invention will be described. Upon operating the recording button of high speed video tape recorder 6, recording is initiated and strobe light 9 activated by strobe power supply 8 emits light. When golfer 1 swings golf club 2, an image in the vicinity of the ball is taken by high speed camera 4, and an image in vicinity of the top of golfer 1 is taken by high speed camera 5, and these images are recorded by high speed video tape recorder 6. When another swinging is video-taped, high speed video tape recorder 6 is stopped temporarily, and the same operation is repeated once again. When the swinging is over, recording by high speed video tape recorder 6 is stopped.

After such images are recorded by high speed video tape recorder 6, the tape is rewound. Then the tape is reproduced, and the images taken by the image-taking/recording system is displayed in display 14. The tape is then forwarded frame by frame by JOG/SHUTTLE to the start of the swing, the time of the start of the swing at which club head 12 starts moving and the time of impact at which club head 12 hits ball 3 from image 10 are detected, and a period of time required from the start of the swing till impact, i.e., swing time is detected.

The tape is then rewound and forwarded using the JOG/SHUTTLE to the point 0.1 second before golf club 2 completely stands still over the head in the swing, in other words 0.1 second before the top of the swing, and high speed video tape recorder 6 is stopped at the point. Based on an original calculation program of personal computer 15, mouse 16 moves the cursor on the image displayed in display 14 for digitizing, and various data is input to produce a swing speed. FIG. 6 is a view showing the movement of club head 12 until the top of the swing at 0.01-second intervals.

The tape is then forwarded using JOG/SHUTTLE and stopped before impact at which club 12 hits ball 3. Based on an original calculation program of personal computer 15, mouse 16 moves the cursor displayed in display 14 for digitizing, and various data is input to produce a head speed.

The above-described head speed is produced by the image-taking/recording system shown in FIG. 1 and the detection device shown in FIG. 2, but the method should not be taken limitatively and the head speed can be produced by using an optical sensor or a magnetic sensor or the like.

The relation shown in the following Table 2 is established between swing speed and optimum frequency.

TABLE 2

| Swing Speed | Optimum Frequency (cpm) |
|---|---|
| 2.0 | 250 |
| 3.0 | 269 |
| 4.0 | 278 |
| 5.0 | 281 |

the relation in Table 2 is prestored in personal computer 15 so that a golf club whose shaft has an optimum flex for a golfer 1 is selected, the selected club is displayed in display 14, and the result is printed in a printing sheet by a printer 17.

According to the embodiment of the invention, the swing speeds of individual golfers are detected, and therefore a golf club having a shaft flex which makes it easiest for each golfer to time or hit can be selected.

In the above-described embodiment, the swinging of golfer 1 is image-taken using high speed cameras 4 and 5, but the method should not be taken limitatively, and home video units such as 8 mm video camera and C-VHS video camera may be used, or the speed in the vicinity of the top of the swing may be detected using an optical sensor in order to detect a swing speed.

Figure 7:
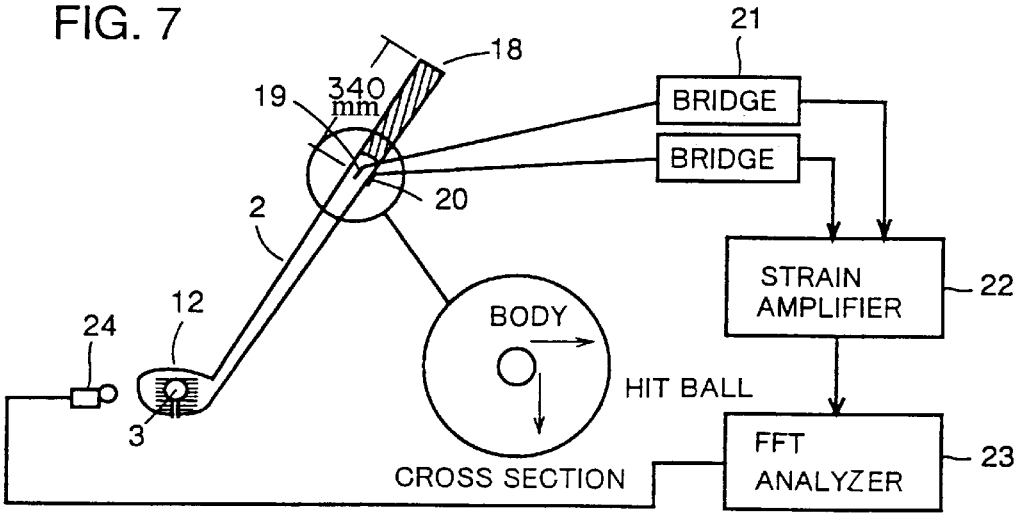
FIG. 7 is a diagram showing another embodiment of the invention.

FIG. 7 shows another embodiment of the invention. In this embodiment, the amount of strain of the shaft of golf club 2 during swinging is measured, an optimum frequency corresponding to the amount of strain is produced to select a flex. More specifically, as shown in FIG. 7, single direction strain gauges 20 are attached at the point 19 located 340 mm from the end 18 of golf club 2 along two directions, the direction of shot and the direction of heels (body) (refer to the cross section), single strain gauges 20 are connected to bridge boxes 21, and strain waveforms during swinging are output to an FFT analyzer 23 through a strain amplifier 22. The sound of impact between club head 12 and ball 3 is collected by a microphone 24 as a sensor trigger input, based on which impact time is set to a fixed time point.

Figure 8:
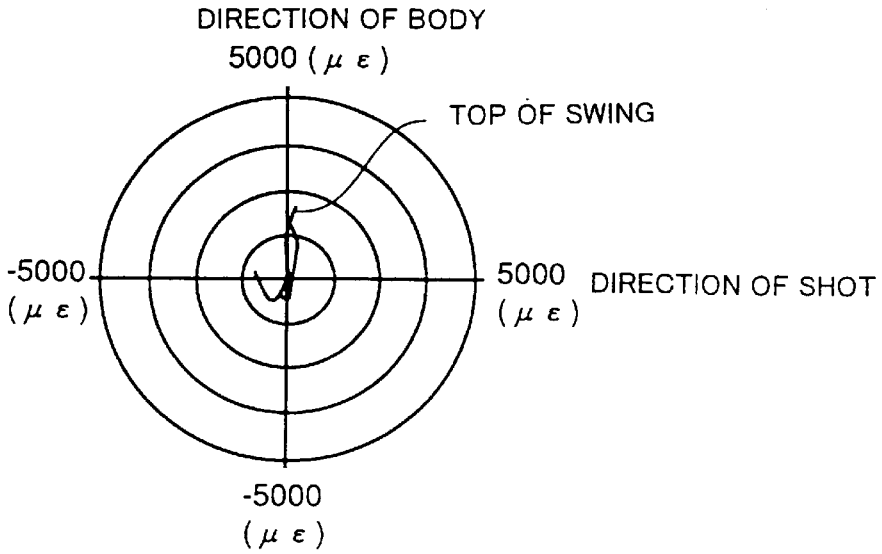
FIG. 8 is a chart showing a combined strain waveform according to the embodiment shown in FIG. 7.

FIG. 8 shows an example of a thus measured combined strain waveform. As shown in FIG. 8, the amount of strain of the shaft is largest in the vicinity of the top while swinging, while golfer 1 can determine best in the vicinity of the top if the swinging is well timed or not, and therefore the amount of strain at the top is measured.

Figure 9:
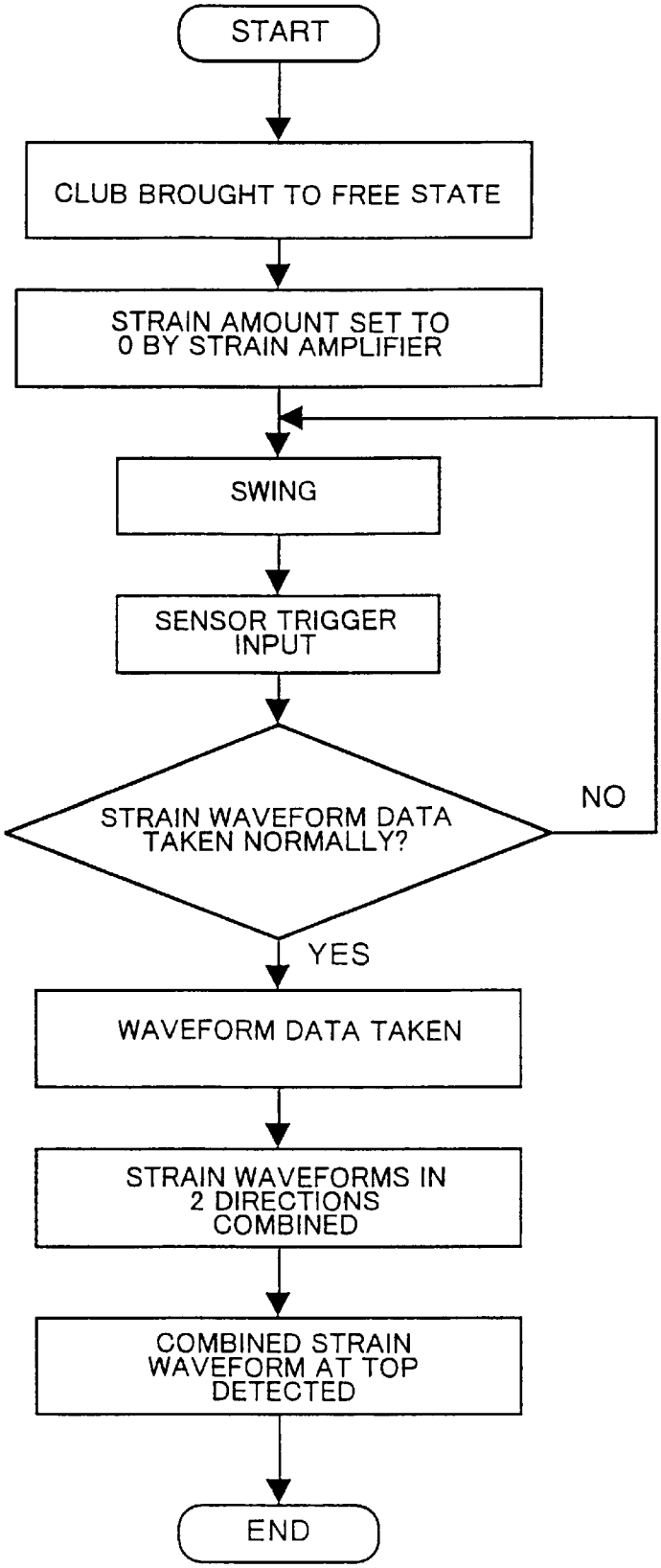
FIG. 9 is a flow chart showing the operation of the detection device shown in FIG. 7.
Figure 10:
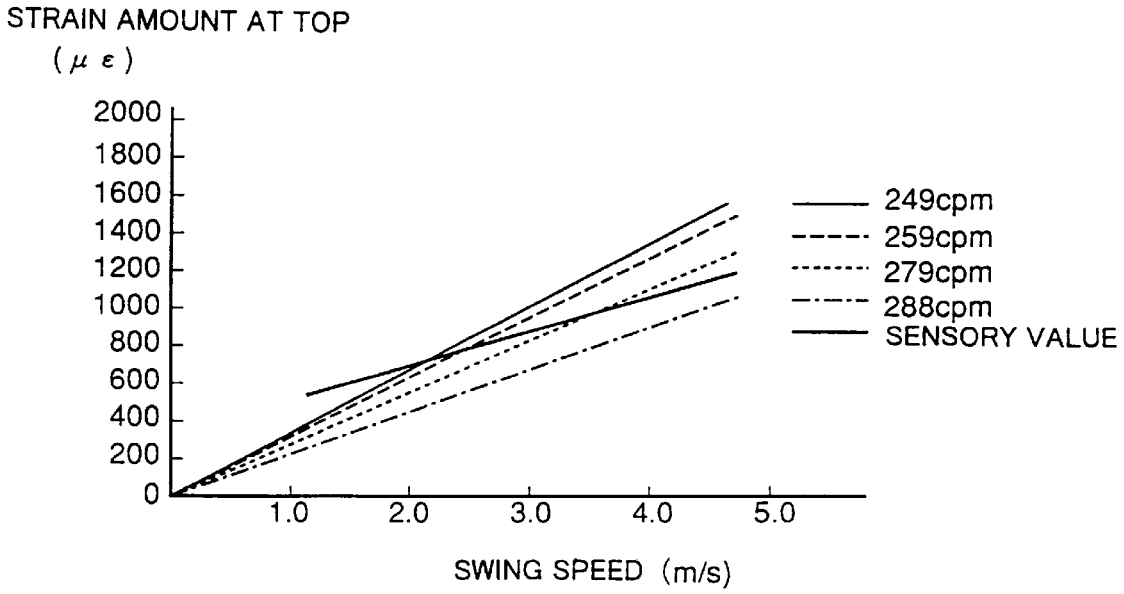
FIG. 10 is a graph showing the relations of swing speeds and combined strains at top as well as frequencies and values by the sensory evaluation by a plurality of golfers by first-order approximation.

FIG. 9 is a flow chart for use in illustration of the operation of the detection device shown in FIG. 7, and FIG. 10 is a graph showing the relation between swing speeds of a number of golfers and the amounts of combined strain at the top for several frequencies as well as the swing speeds and values produced by sensory evaluations by first-order approximation.

As shown in FIG. 9, golf club 2 is brought to a free state, and the amount of strain is set to 0 by strain amplifier 22. When a golfer swings golf club 2, the sound of the club hitting the ball is collected by microphone 24, and input by the sensor trigger. The amount of strain upon swinging golf clubs 2 is detected by single strain gauges 20 and input to FFT analyzer 23 from bridge boxes 21 through strain amplifier 22. It is determined if strain waveform data is taken in normally, and if not, golf club 2 is once again swung. If the data is normally taken in, waveform data is input, the strain waveforms along the two directions are combined, and the combined strain waveform at the top is detected. The swing speeds of a plurality of golfers and the combined strain amounts at the top for various frequencies as well as the swing speeds and values produced from the sensory evaluations are expressed by first-order approximation in FIG. 10. The first-order approximation straight lines shown in FIG. 10 are expressed as follows:

$$249\ (cpm):\ y=354x \tag{1}$$

$$259\ (cpm):\ y=331x \tag{2}$$

$$276\ (cpm):\ y=290x \tag{3}$$

$$288\ (cpm):\ y=246x \tag{4}$$

Optimum frequency produced from sensory evaluation:

$$y=217x+270 \tag{5}$$

wherein x: swing speed, and y: combined strain amount at the top.

By applying he expressions (1) to (5), an optimum frequency for each swing speed can be found by calculation. The relation between the swing speeds and the optimum frequencies is as in the above Table 2.

Meanwhile, when a ball is hit using a shaft having a certain frequency, an optimum frequency can be found from the amount of strain of the shaft at the top, and values for a shaft having 276 (cpm) are set forth in the following Table 3 by way of example.

TABLE 3

| Strain Amount at Top ($\mu\epsilon$) | Optimum Frequency (cpm) |
|---|---|
| 580 | 250 |
| 870 | 269 |
| 1160 | 278 |
| 1450 | 281 |

strain amount at top - strain of shaft with 276 (cpm)

Note that the swing speed may be replaced with swing time (time from the start of swinging till impact) or time from the start of swinging till the top of the swing. The swing speed described above is produced using the image-taking/recording system shown in FIG. 1 and the detection device shown in FIG. 2, but the invention should not be taken limitatively, and a stop watch, a 8 mm video camera and a C-VHS video taping system (camcorder, CCD video or the like), or an optical sensor and a magnetic sensor may be used to produce the swing time.

Figure 11:
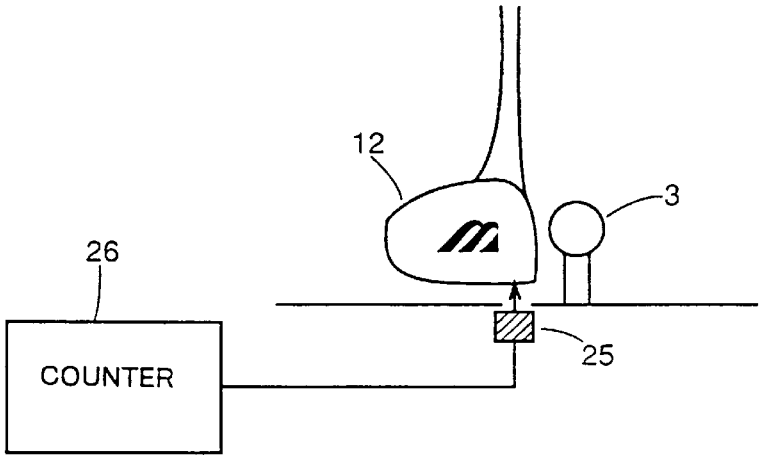
FIG. 11 is a diagram showing another embodiment of the invention.

FIG. 11 is a diagram showing an embodiment using the optical sensor. In FIG. 11, a laser type optical sensor 25 is provided under the floor under the bottom (sole) of club head 12. Before golfer 1 starts swinging, optical sensor 25 illuminates the sole in its ON state, is turned off at the start of swinging, and is once again turned on when club head 12 returns to the point for impact. Time from the ON to the ON, in other words swing time is output to a counter 26. An optimum frequency is produced based on the swing time displayed at counter 26. Optimum frequencies for various swing time are set forth in Table 4.

TABLE 4

| Swing Time (s) | Optimum Frequency (cpm) |
|---|---|
| 1.70 | 250 |
| 1.46 | 269 |
| 1.22 | 278 |
| 0.98 | 281 |

Figure 12:
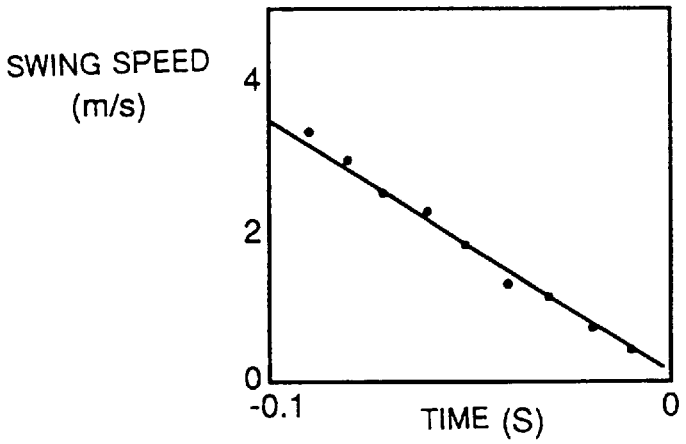
FIG. 12 is a graph showing swing speeds in time series.
Figure 13:
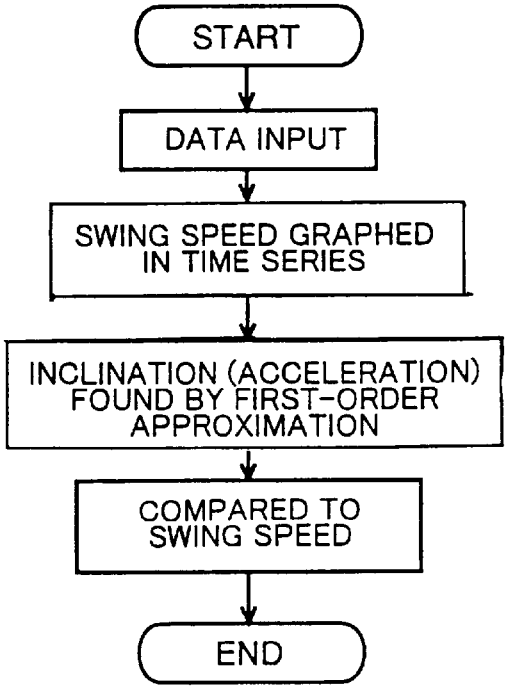
FIG. 13 is a flow chart showing the procedure of detection according to another embodiment of the invention.
Figure 14:
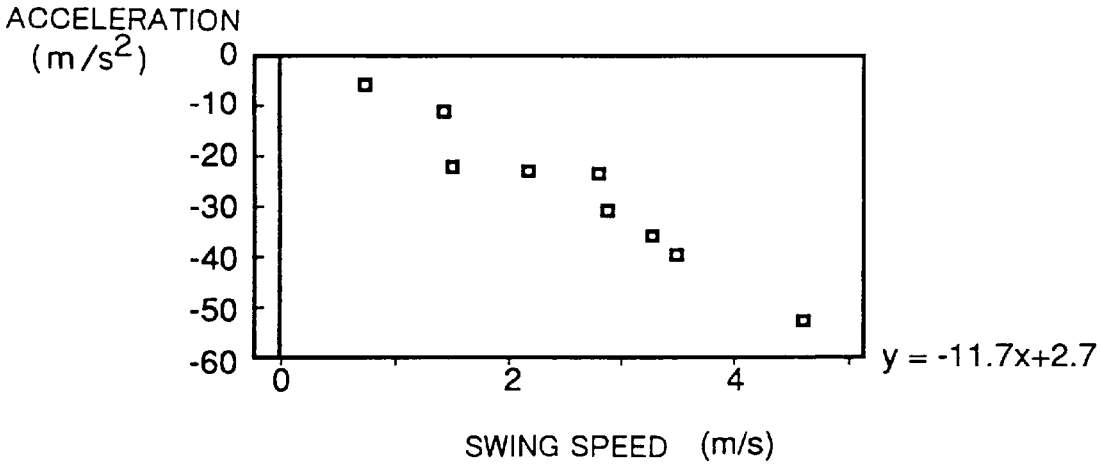
FIG. 14 is a graph showing the relation between swing speed and acceleration.

In another embodiment, the acceleration of the head of a golf club from 0.1 seconds before the top of the swing until the top of the swing is found, and an optimum frequency for each acceleration may be produced. For detection, swing speeds produced from the detection device shown in FIG. 2 are expressed in a graph in time series, represented by means of first-order approximation, and the inclination (negative acceleration) may be produced. FIG. 12 is a graph showing swing speeds in time series, while FIG. 13 is a flow chart for use in illustration of the operation of detection means in yet another embodiment of the invention. FIG. 14 is a graph showing the relation between swing speed and acceleration.

In this embodiment, as shown in FIG. 13, after input of data, swing speeds are expressed in a graph in time series, approximated by a linear expression, and the inclination is produced for comparison with the swing speeds. As shown in FIG. 14, in the relation between swing speed and acceleration the coefficient of correlation is as high as 0.97, and the swing speed may be replaced with the acceleration. The first-order approximation straight line of swing speed and acceleration can be expressed as follows:

$$y=-11.7x+2.7 \quad (6)$$

An optimum frequency can be produced for each acceleration. The relation between each acceleration and the optimum frequency is set forth in the following Table 5.

TABLE 5

| Acceleration ($m/s^{-}$) | Optimum Frequency (cpm) |
|---|---|
| −20.7 | 250 |
| −32.4 | 269 |
| −44.1 | 278 |
| −55.8 | 281 |

The above-described relation between each acceleration and the optimum frequency is stored in personal computer 15 so that a shaft with an optimum flex for a golfer can be selected.

Figure 15:
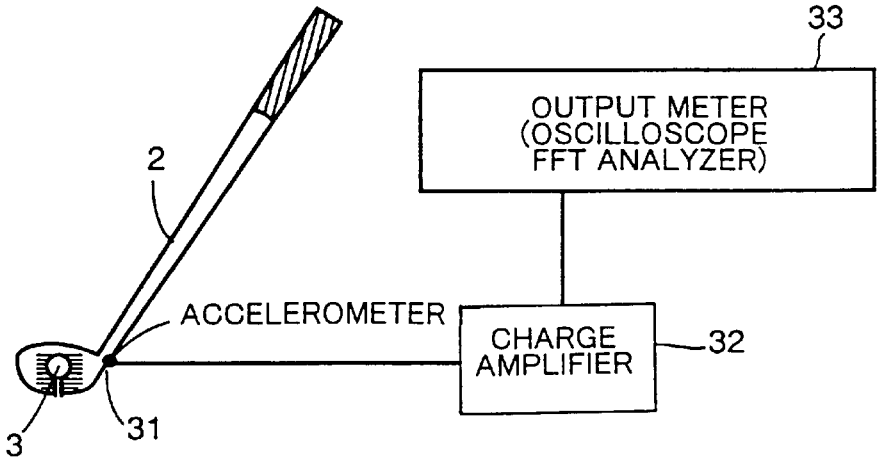
FIG. 15 is a diagram showing another embodiment of the invention.

FIG. 15 is a diagram showing another embodiment of the invention. In FIG. 15, accelerometer 31 is provided at the head of golf club 2, and the output of accelerometer 31 is output to an output meter 33 such as oscilloscope and FFT analyzer through a charge amplifier 32. An optimum frequency is produced based on an acceleration displayed at output meter 33.

Lastly, the range of tolerance for swing time, swing speed, acceleration, shaft strain amount at the top, and optimum frequency found by experiments based on the invention are set forth in Table 6.

TABLE 6

| Swing Time (s) | Swing Speed (m/s) | Acceleration ($m/s^{-}$) | Strain Amount of Shaft at Top ($\mu\epsilon$ = ratio of the amount of deformation in length after force is applied and before the force is applied) | Optimum Frequency (cpm) |
|---|---|---|---|---|
| 1.6 ± 0.1 and more | 2 ± 0.2 and less | −21 ± 2 and less | 580 ± 50 and less | 250 ± 5 and less |
| 1.6 ± 0.1 | 2 ± 0.2 | −21 ± 0.2 | 580 ± 50 | 250 ± 5 |
| ~1.4 ± 0.1 | ~3 ± 0.2 | ~33 ± 2 | ~870 ± 50 | ~270 ± 5 |
| 1.4 ± 0.1 | 3 ± 0.2 | −33 ± 2 | 870 ± 50 | 270 ± 5 |
| ~1.2 ± 0.1 | ~4 ± 0.2 | ~44 ± 2 | ~1160 ± 50 | ~280 ± 5 |
| 1.2 ± 0.1 and less | 4 ± 0.2 and more | ~44 ± 2 and more | 1160 ± 50 and more | 280 ± 5 and more |

strain amount at top - strain amount of shaft with 276 (cpm)

In another embodiment, swing speed and head speed produced using the image-taking/recording system shown in FIG. 1 and the detection device shown in FIG. 2 are considered as items for selecting optimum flexes.

Figure 16:
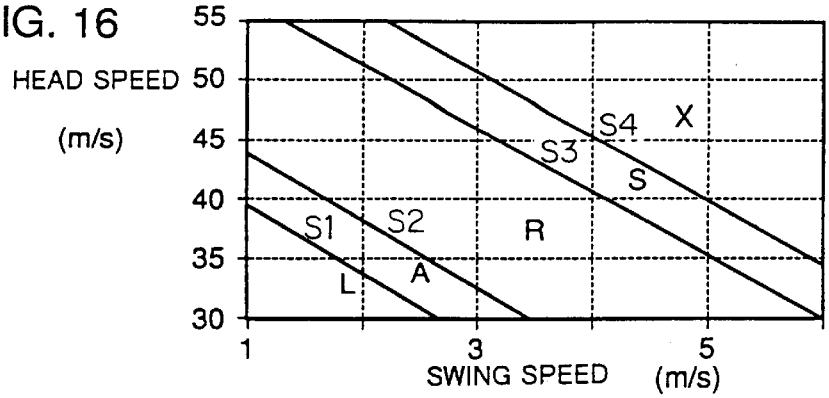
FIG. 16 is a graph showing optimum flex selections produced from swing speed, head speed and the result of sensory evaluation.

FIG. 16 is a graph showing an embodiment for selecting an optimum flex found based on a swing speed, a head speed and a result of sensory evaluation. Note that the sensory evaluation is conducted by means of paired comparison test, subjects were selected among advanced players so that differences between flexes can accurately be evaluated by means of paired comparison test.

The straight lines in FIG. 16 are expressed by y=ax+b, wherein x: swing speed (m/s)

y: head speed (m/s), and a and b fall within the ranges represented by the following expressions.

Straight line S1: $-6.10 \leqq a \leqq -4.50 \quad 41.5 \leqq b \leqq 46.1$ (7)

Straight line S2: $-6.10 \leqq a \leqq -4.50 \quad 46.1 \leqq b \leqq 50.7$ (8)

Straight line S3: $-6.10 \leqq a \leqq -4.50 \quad 59.3 \leqq b \leqq 63.9$ (9)

Straight line S4: $-6.10 \leqq a \leqq -4.50 \quad 63.9 \leqq b \leqq 68.5$ (10)

Note that the above straight lines in FIG. 16 are expressed as follows:

Straight line *S*1: $y=-5.30x+43.8$ (11)

Straight line *S*2: $y=-5.30x+48.4$ (12)

Straight line *S*3: $y=-5.30x+61.6$ (13)

Straight line *S*4: $y=-5.30x+66.2$ (14)

As a result, in the embodiment shown in FIG. 16, detection of the swing speed and head speed at impact of a golfer makes it possible to select a golf club having a shaft with a flex the easiest to time or hit for the golfer.

In another embodiment, head speeds and strain amounts at top produced from the image-taking/recording system shown in FIG. 1 and the detection devices shown in FIGS. 2 and 7 are considered as items for selection of optimum flexes.

Figure 17:
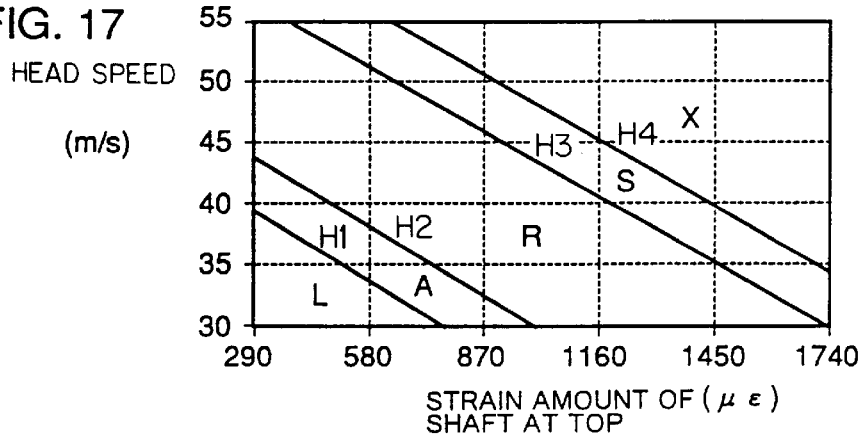
FIG. 17 is a graph showing optimum flex selections produced from the amount of strain at top, head speed and the result of sensory evaluation.

FIG. 17 is a graph showing an embodiment for selecting an optimum flex based on a strain amount at top, a head speed and a result of sensory evaluation. Note that the shaft used has a frequency of 276 (cpm).

The sensory evaluation was conducted by means of paired comparison test, and subjects were selected among advanced players capable of accurately evaluating differences between flexes.

The straight lines shown in FIG. 17 are expressed by y=ax+b, wherein x: shaft strain amount at top ($\mu\epsilon$)

y: head speed (m/s), and a and b fall within the following ranges:

Straight line H1: $-2.10*10^{-2} \leqq a \leqq -1.55*10^{-2} \quad 41.5 \leqq b \leqq 46.1$ (15)

Straight line H2: $-2.10*10^{-2} \leqq a \leqq -1.55*10^{-2} \quad 46.1 \leqq b \leqq 50.7$ (16)

Straight line H3: $-2.10*10^{-2} \leqq a \leqq -1.55*10^{-2} \quad 59.3 \leqq b \leqq 63.9$ (17)

Straight line H4: $-2.10*10^{-2} \leqq a \leqq -1.55*10^{-2} \quad 63.9 \leqq b \leqq 68.5$ (18)

Note that in FIG. 17, the above straight lines are expressed by the following expressions.

Straight line *H*1: $y=-1.83*10^{-2}x+43.8$ (19)

Straight line *H*2: $y=-1.83*10^{-2}x+48.4$ (20)

Straight line *H*3: $y=-1.83*10^{-2}x+61.6$ (21)

Straight line *H*4: $y=-1.83*10^{-2}x+66.2$ (22)

Further in another embodiment, swing time and a head speed produced from the image-taking/recording system shown in FIG. 1 and the detection device shown in FIG. 2 are considered as selection items for optimum flexes.

Figure 18:
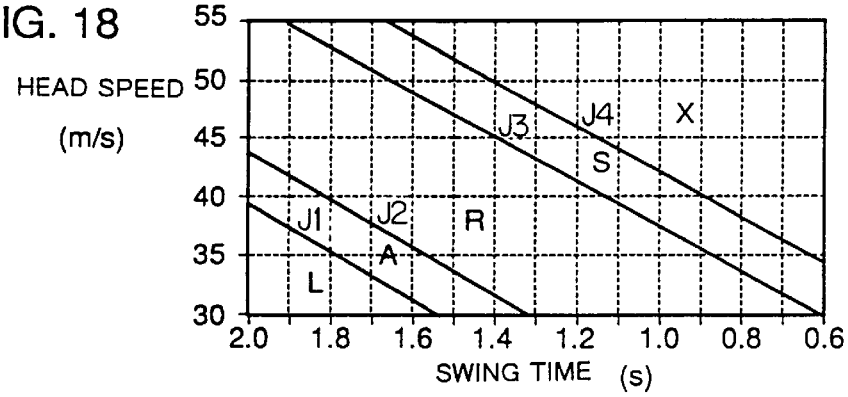
FIG. 18 is a graph showing optimum flex selections produced from swing time, head speed and the result of sensory evaluation.

FIG. 18 is a graph showing an embodiment for selecting an optimum flex based on swing time, a head speed and a result of sensory evaluation. Also in this embodiment, the sensory evaluation was conducted by means of paired comparison test and subjects were selected among advanced players capable of accurately evaluating differences between the flexes.

The straight line in FIG. 18 is expressed by y=ax+b, wherein x: swing time (s)

y: head speed (m/s), and a and b fall within the following ranges

Straight line J1: $16.1 \leqq a \leqq 21.8 \quad -7.46 \leqq b \leqq 9.46$ (23)

Straight line J2: $16.1 \leqq a \leqq 21.8 \quad -3.54 \leqq b \leqq 14.1$ (24)

Straight line J3: $16.1 \leqq a \leqq 21.8 \quad 9.66 \leqq b \leqq 27.3$ (25)

Straight line J4: $16.1 \leqq a \leqq 21.8 \quad 14.3 \leqq b \leqq 31.9$ (26)

Note that in FIG. 18 the above straight lines are expressed by the following expressions Straight line *J*1: $y=18.9x+0.72$ (27)

Straight line *J*2: $y=18.9x+5.32$ (28)

Straight line *J*3: $y=18.9x+18.5$ (29)

Straight line *J*4: $y=18.9x+23.1$ (30)

Further in another embodiment, an acceleration and a head speed produced from the image-taking/recording system shown in FIG. 1 and the detection device shown in FIG. 2 are considered as items for selecting optimum flexes.

Figure 19:
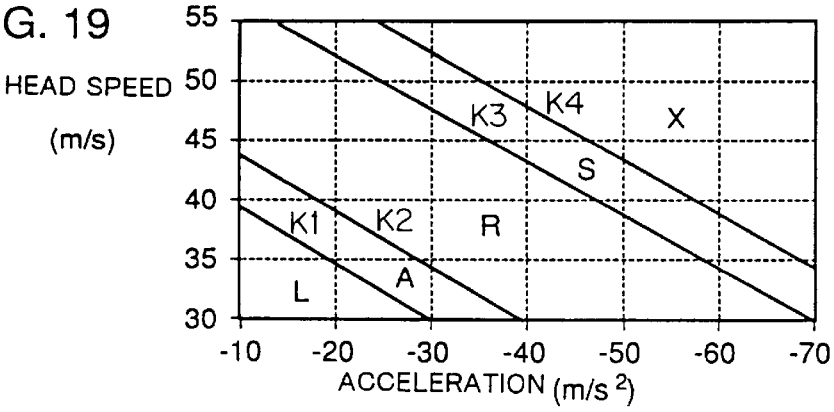
FIG. 19 is a graph showing optimum flex selections produced from acceleration, head speed and the result of sensory evaluation.

FIG. 19 is a graph showing the embodiment for selecting optimum flexes based on an acceleration, a head speed and a result of sensory evaluation. In this embodiment, the sensory evaluation was conducted by means of paired comparison test, and subjects were selected among advanced players capable of accurately evaluating differences between flexes.

The straight lined shown in FIG. 19 are expressed by y=ax+b, wherein x: acceleration ($m/s^2$)

y: head speed (m/s)

and a and b fall within the following ranges

Straight line K1: $0.38 \leqq a \leqq 0.51 \quad 40.5 \leqq b \leqq 45.4$ (31)

Straight line K2: $0.38 \leqq a \leqq 0.51 \quad 45.1 \leqq b \leqq 49.9$ (32)

Straight line K3: $0.38 \leqq a \leqq 0.51 \quad 58.3 \leqq b \leqq 63.2$ (33)

Straight line K4: $0.38 \leqq a \leqq 0.51 \quad 62.9 \leqq b \leqq 67.8$ (34)

Note that in FIG. 19 the above straight lines are represented by the following expressions:

Straight line *K*1: $y=0.44x+42.9$ (35)

Straight line *K*2: $y=0.44x+47.5$ (36)

Straight line *K*3: $y=0.44x+60.7$ (37)

Straight line *K*4: $y=0.44x+65.3$ (38)

Figure 20:
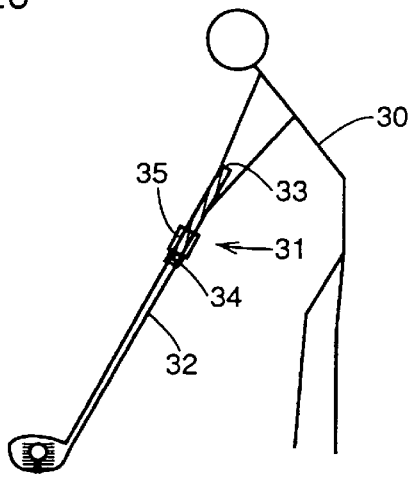
FIG. 20 is a diagram showing another embodiment of the invention.

FIG. 20 shows another embodiment of the invention. In this embodiment, the maximum strain amount of a shaft when a golfer 30 swings a golf club 31 is detected using a strain gauge 34 attached at a position 340 mm from a grip end 33, and the detected strain amount is displayed at the indicator of a selecting device 35.

Although strain gauge 34 is attached at the position 340 mm from grip end 33, it is preferable to attach the gauge at a position about 260 mm–500 mm from grip end 33 in order to obtain a larger strain value.

Also in this embodiment, the strain gauge was attached in a single direction along the direction of the body, an additional strain gauge may be attached in the direction of a shot, and a combined strain amount along these two directions may be detected.

Figure 21:
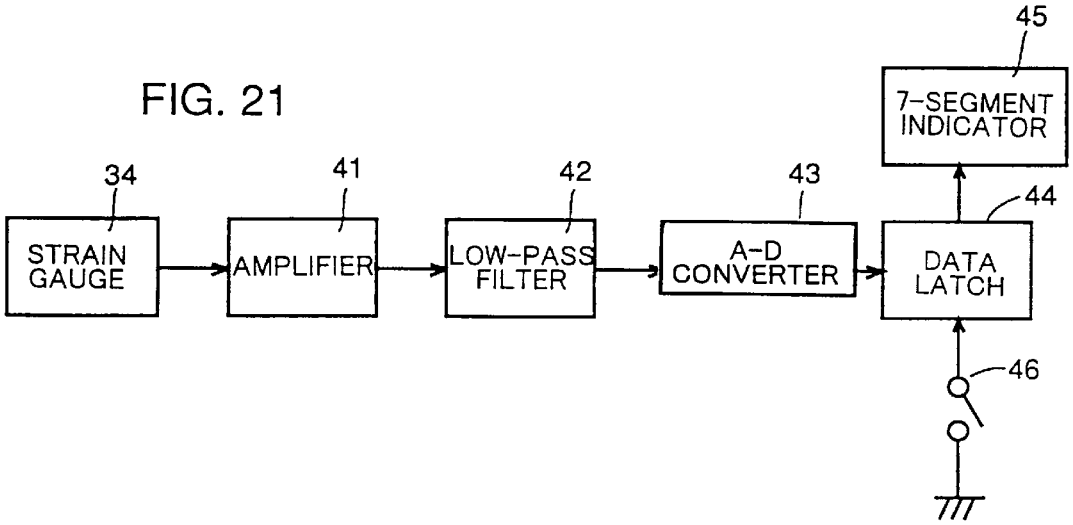
FIG. 21 is a block diagram specifically showing the structure of the selecting apparatus shown in FIG. 20.

FIG. 21 is a block diagram specifically showing selecting device 35 in FIG. 20. In FIG. 21, the output of strain gauge 34 is applied to amplifier 41 for amplification, then provided to a 10 Hz low-pass filter 42 and removed of its waveform after impact. The output of low-pass filter 42 is applied to an A-D converter 43 and digitized into a digital signal to be latched by a data latch 44. The data latched by data latch 44 is indicated at a 7-segment indicator 45. The data latched by data latch 44 is reset in response to an operation of a reset switch 46.

Figure 22:
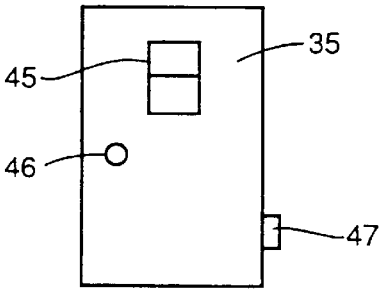
FIG. 22 is an overview showing the selecting apparatus in FIG. 20 attached to the grip.

FIG. 22 is an overview showing selecting device 35 attached at the grip shown in FIG. 20. In FIG. 22, 7-segment indicator 45 and reset switch 46 are attached on a surface of selecting device 35, and a power supply switch 47 is provided on a side. In selecting device 35, amplifier 41, low-pass filter 42, A-D converter 3, data latch 44 and a battery all mounted on a printed circuit board are accommodated, and selecting device 35 is attached at grip 31 with a band or the like.

Figure 23:
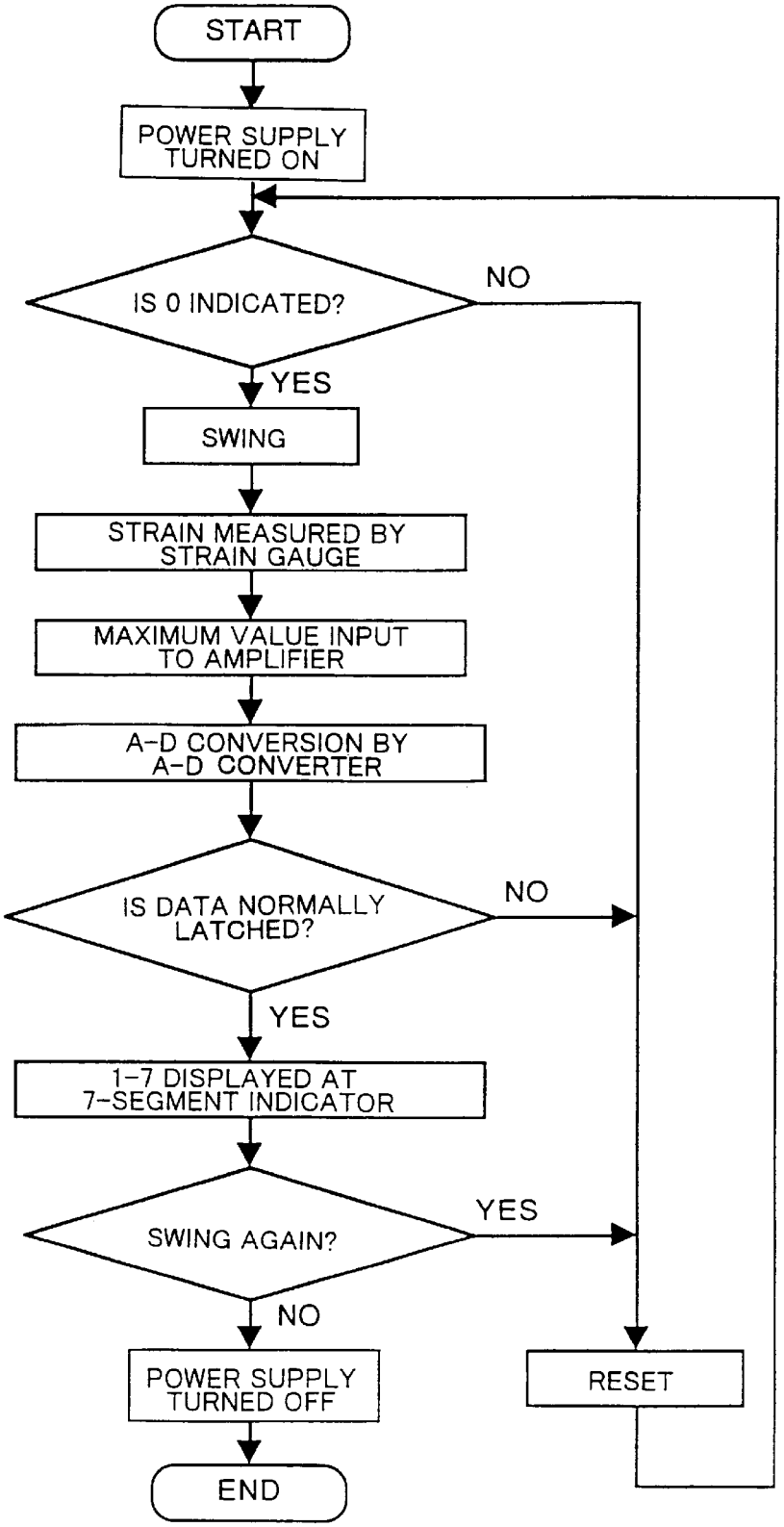
FIGS. 23 and 24 are flow charts for use in illustration of the operation of another embodiment of the present invention.
Figure 24:
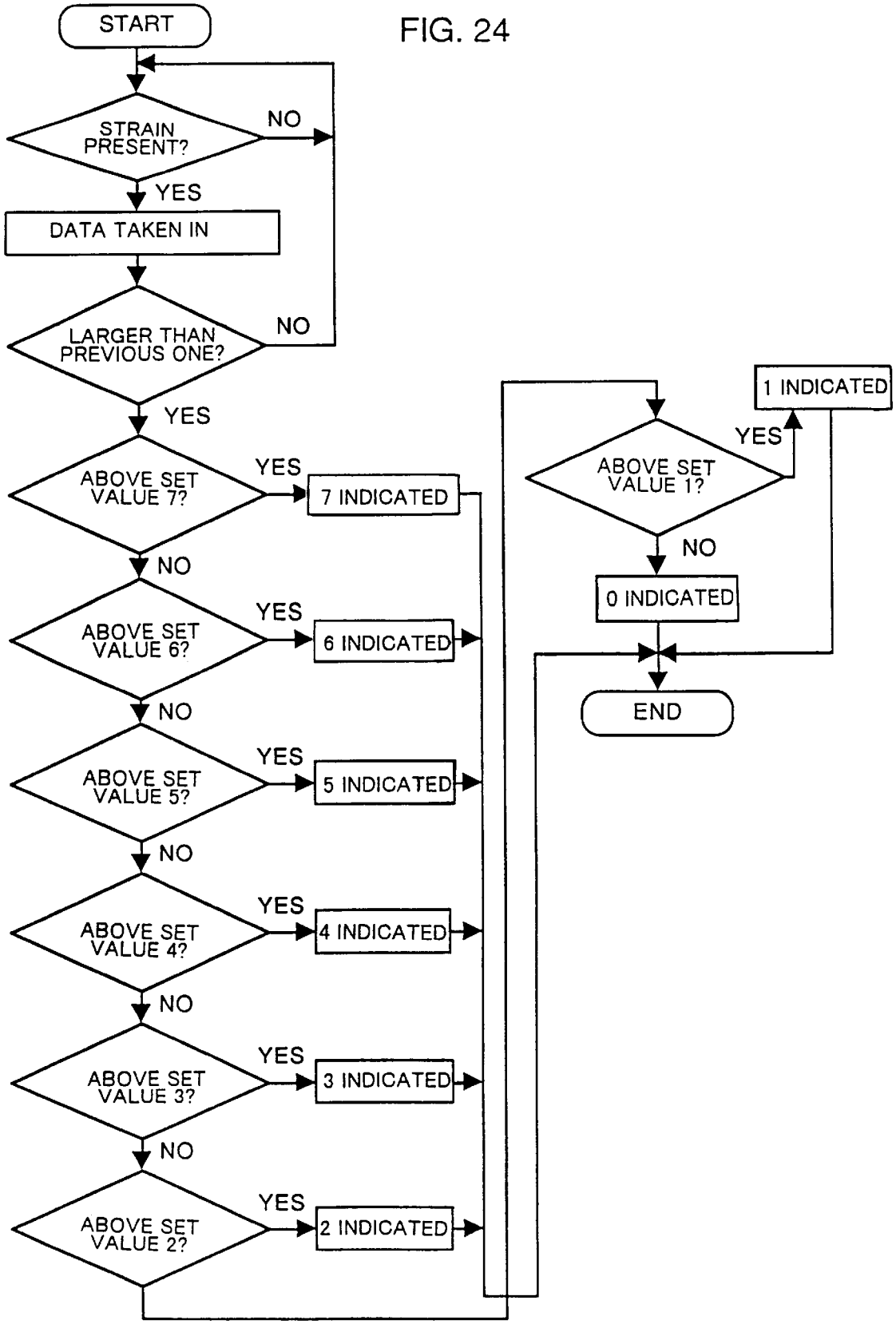
Figure 25:
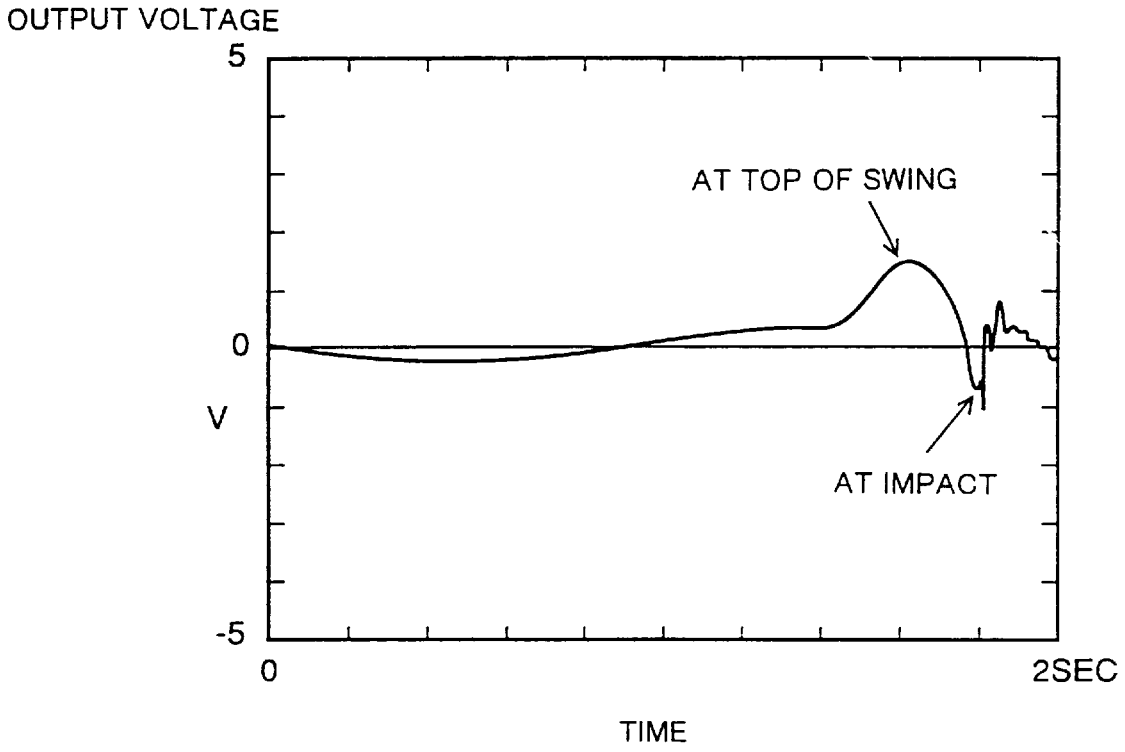
FIG. 25 is a graph showing the relation between the amount of strain and time measured in this embodiment.

FIGS. 23 and 24 are flow charts for use in illustration of the operation of another embodiment of the invention, and FIG. 25 is a graph showing the relation between measured strain amount and time in this embodiment.

Referring to FIGS. 21 to 25, the operation of another embodiment will be described. Golfer 30 turns on the power supply operating power supply switch 47, confirms if 0 is indicated at 7-segment indicator 45, and operates reset switch 46 to reset data latch 44 if 0 is not indicated. Golfer 30 then swings golf club 31. Strain gauge 34 outputs a voltage corresponding to the strain of shaft 32 created by the swinging, the voltage is amplified by amplifier 41, only a low-frequency component of the amplified voltage is extracted by low-pass filter 2, and the extracted component is converted into a digital signal by A-D converter 43 to be latched by data latch 44. If data is not normally latched by data latch 44, golfer 30 operates reset switch 46 to reset data latch 44. If data is normally latched by data latch 44, the data is indicated at 7-segment indicator 45. For another swinging, reset switch 46 is operated, and power supply switch 47 is turned off upon completion.

Referring to FIG. 24, the operation of indicating data at 7-segment indicator 45 will be described. Strain is detected by strain gauge 34, the data is latched by data latch 44, and then it is determined if the data is larger than the previous one. If the strain is larger than the previous one, it is then determined if the data is above a set value 7. If it is above the set value 7, 7 is indicated at 7-segment indicator. If the data is not above the set value 7, it is then determined if the data is above a set value 6, and if it is above the value, 6 is indicated. If it is not above the value, it is then determined if the data is above a set value 5. If the data is above the set value 5, 5 is indicated and if not, it is then determined if the data is above a set value 4. If it is above the value, 4 is indicated. If not, it is then determined if the data is above a set value 3. If it is above 3, 3 is indicated, and if not, it is then determined if the data is above a set value 2. If it is above the value, 2 is indicated, and if not it is then determined if the data is above a set value 1. If it is above the value, 1 is indicated, and if not 0 is indicated. These values 0 to 7 correspond to the strain amounts shown in FIG. 25. More specifically, a maximum value for strain is set to 7, and smaller strains are indicated by 6, 5, 4, . . . .

INDUSTRIAL APPLICABILITY OF THE INVENTION

As in the foregoing, according to the present invention, measuring any of swing time, swing speed, acceleration and shaft strain for individual golfers or measuring head speed in addition to these items makes it possible to select a golf club having a shaft with a flex the easiest to time or hit for each golfer.

What is claimed is:

1. A shaft selecting apparatus for selecting a golf club shaft with an optimum flex for a golfer, comprising:

a speed detection unit for detecting a speed of the head of a golf club in the vicinity of the top of the swing; and a selecting unit for selecting the golf club shaft with an optimum flex for said golfer based on the speed of the club head detected by said speed detection unit.

2. The shaft selecting apparatus for selecting a golf club shaft with an optimum flex for a golfer as recited in claim 1, further comprising:

an image-taking device for taking an image of a movement of the club head in the vicinity of a ball and in the vicinity of the top of the swing when said golfer swings the golf club and hits a ball; and an image-recording device for recording the image taken by said image-taking device, wherein said speed detection unit includes a speed operation unit for detecting the speed of said club head based on an image reproduced from said image-recording device.

3. The shaft selecting apparatus for selecting a golf club shaft with an optimum flex for a golfer as recited in claim 1, wherein said speed detection unit includes an optical sensor for detecting a speed of said swinging in the vicinity of the top of the swing; and a device for detecting the speed of said club head based on the detection output of said optical sensor.

4. A shaft selecting apparatus for selecting a golf club shaft with an optimum flex for a golfer, comprising:

a speed detection unit for detecting the speed of the club head of a golf club in the vicinity of the top of the swing;

an impact speed detection unit for detecting the speed of the club head at impact; and a selecting unit for selecting the golf club shaft with an optimum flex for said golfer based on the speed of the club head detected by said speed detection unit and the speed of the club head at impact detected by said impact speed detection unit.

5. The shaft selecting apparatus for selecting a golf club shaft with an optimum flex for a golfer as recited in claim 4, further comprising:

an image-taking device for taking an image of a movement of the club head in the vicinity of a ball and in the vicinity of the top of the swing when said golfer swings the golf club and hits the ball; and an image-recording device for recording the image taken by said image-taking device, wherein said speed detection unit includes a speed operation unit for detecting the speed of said club head based on an image reproduced from said image-recording device.

* * * * *

UNITED STATES PATENT AND TRADEMARK OFFICE

CERTIFICATE OF CORRECTION

PATENT NO. : 6,003,368

DATED : December 21, 1999

INVENTOR(S) : Takeshi NARUO, et al.

It is certified that error appears in the above-identified patent and that said Letter Patent is hereby corrected as shown below:

On the Title page:

Section [62], change "October 12, 1985" to --October 12, 1995--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*